United States Patent [19]

Schneider et al.

[11] Patent Number: 4,481,847

[45] Date of Patent: Nov. 13, 1984

[54] CIRCUIT ARRANGEMENT FOR AN ADJUSTING DRIVE FOR A PRESS RAM ADJUSTMENT

[75] Inventors: Franz Schneider, Göppingen; Ewald Bergmann, Rechberghausen; Gerhard Gering, Süssen, all of Fed. Rep. of Germany

[73] Assignee: L. Schuler GmbH, Göppingen, Fed. Rep. of Germany

[21] Appl. No.: 368,588

[22] Filed: Apr. 15, 1982

Related U.S. Application Data

[62] Division of Ser. No. 62,579, Aug. 1, 1979, Pat. No. 4,378,717.

[30] Foreign Application Priority Data

Aug. 2, 1978 [DE] Fed. Rep. of Germany ..... 2833829

[51] Int. Cl.[3] ..... B26D 7/26; B30B 15/14

[52] U.S. Cl. ..... 83/530; 83/527; 83/916; 100/257; 173/2

[58] Field of Search ..... 83/530, 527; 100/257, 100/428; 173/2, 115

[56] References Cited

U.S. PATENT DOCUMENTS

| | | | |
|---|---|---|---|
| 3,162,232 | 12/1964 | Munschauer et al. | 83/527 X |
| 3,687,069 | 8/1972 | Helrigel et al. | 83/527 X |
| 3,780,814 | 12/1973 | Herb | 83/530 X |
| 4,016,787 | 4/1977 | Sugimoto | 83/72 X |
| 4,033,252 | 7/1977 | Baker | 100/257 X |
| 4,135,446 | 1/1979 | Bareis et al. | 83/530 X |

*Primary Examiner*—Donald R. Schran

*Attorney, Agent, or Firm*—Craig & Burns

[57] ABSTRACT

A circuit or control arrangement for an adjusting drive of a press ram of a high-speed cutting press which includes top and bottom dies respectively attached to the press ram and a platen of the press with the top die being adapted to dip or penetrate during a cutting process into the bottom die. An arrangement is provided for maintaining the depth of penetration of the upper die means into the lower die means to a constant value in dependence upon an operating condition of the high-speed cutting press. The maintaining arrangement may include at least one limit switch operatively connected with an oscillator stage which provides adjusting signals to the drive motor. In lieu of a limit switch, a cutting force measuring sensor member may be interconnected with an evaluator circuit and the oscillator means so as to control the drive motor.

6 Claims, 2 Drawing Figures

CIRCUIT ARRANGEMENT FOR AN ADJUSTING DRIVE FOR A PRESS RAM ADJUSTMENT

Figure 1:
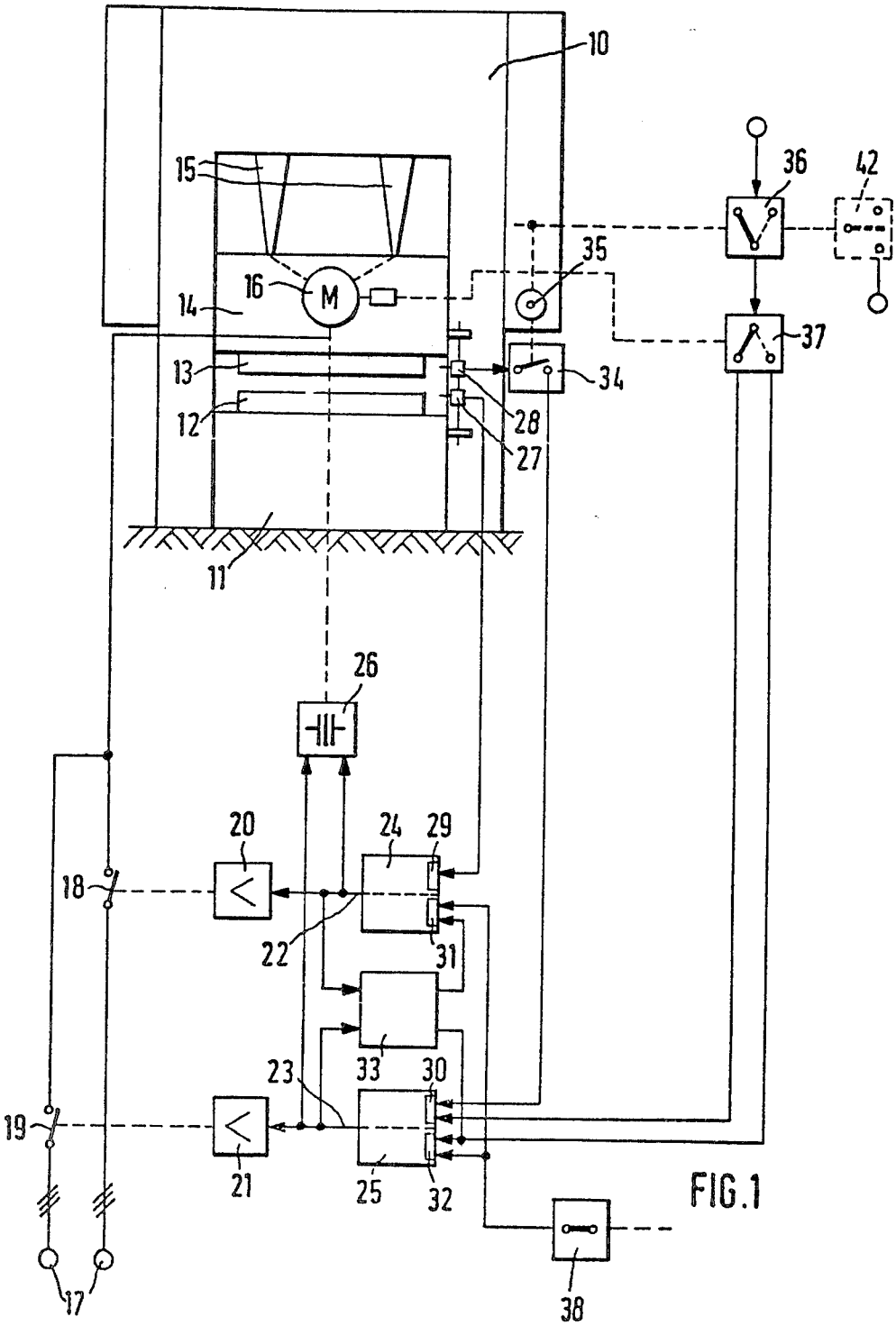

This is a division of application Ser. No. 062,579, filed Aug. 1, 1979, now U.S. Pat. No. 4,378,717.

The present invention relates to a press construction and, more particularly, to a circuit arrangement for an adjusting drive for a ram adjustment on cutting presses, particularly high-speed cutting presses which include a top die or tool attached to the press ram and a bottom die, which accommodates the top die during a cutting process, attached to the press platen. The ram is adjustable relative to operating cranks by way of a gear train having a high transmission ratio during operation of the cutting press. The operating cranks and the ram are capable of being tensioned with respect to each other, with the gear train being connected to a motor which can be controlled by way of an oscillator stage by adjusting signals determined in dependence upon the operating condition of the cutting press so as to keep the depth to which the top die is displaced into the bottom die at a constant value.

In general, adjusting drives have been proposed in, for example, German Offenlegungsschrift No. 15 02 283 for adjusting the position of the ram stroke for each set of tools used. The adjustment is made outside of normal operation, that is, basically during a stand still condition of the cutting press at the bottom dead center position of the press ram. After the adjustment has been made, the ram is then tensioned preferably hydraulically with respect to the operating cranks and the cutting press can then be operated.

Additionally, in the German Journal "Blech", volume 7, 1960, No. 9, page 490, a press is proposed in which the adjustment of the press ram can also be performed in accordance with the height of the tool set when the press is running. However, the proposed presses in the journal are relatively slow-running C-frame presses.

Particularly high-speed cutting presses, it has become apparent that with an increasing operating speed, that is, a greater number of press ram strokes, the upper die is displaced farther into the associated lower die. With high-speed cutting presses with, for example, more than 600 strokes per minute, this process leads to an increase in die or tool wear. The increasing use of expensive hard metal tools in the high-speed cutting presses thus results in high costs for the replacement of fast-wearing tools and increases the overall production expenses.

To avoid the cause for increased wear of tools due to the increasing depth to which the top die is inserted into the bottom die with an increase in the cutting press speed, it has been proposed in generic high-speed cutting presses, in which the press ram is adjustable during operation relative to the operating crank by way of a high transmission ratio gear train, to connect the gear train to a motor which can be controlled by an oscillator stage. This control is achieved by adjusting signals which are determined in dependence upon the operating condition of the cutting press with the aim of such proposal being the maintenance of the depth to which the top die is inserted into the bottom die at a constant value.

The aim underlying the present invention essentially resides in further improving the last proposed construction by providing a circuit arrangement for a high-speed press which maintains the depth to which the top die is inserted into the bottom die at a constant value.

In accordance with the present invention, at least one adjustable limit switch is mounted at a frame member of the press in the path of action of the press ram with the operating condition of the at least one limit switch being sensed. A signal output of the limit switch is connected to a first set input of the oscillator stage with a first signal of the oscillator stage being fed back to a reset input by way of a switching stage 33 determining the amplitude of the adjusting step of the press ram. A second set input of the oscillator stage is connected to a switching element which senses the interruption of the operation of the cutting press and a reset input is connected with a switching stage sensing the bottom end position of the press ram. The first signal output activates the motor in the sense of a "ram up" with the second signal output activating the motor in the sense of a "ram down".

By virtue of the above-noted features of the present invention, by a simple adjustment of the limit switch, the oscillator stage can be controlled directly.

In accordance with the present invention, a second adjustable limit switch may be mounted at the frame of the press in the path of action of the ram with the second limit being connected to the second set input of the oscillator stage in series with a sensing switch. The second signal output is fed back to a reset input by way of the switching stage determining the amplitude of the adjusting step of the press ram with the sensing switch being actuated within a predetermined short period of time of one stroke of the press ram.

In accordance with further advantageous features of the present invention, for sensing the operating condition of the press, a cutting force measuring sensor is provided which is followed by an evaluating circuit. The signal outputs of the evaluating circuit are connected to a first and second set input of the oscillator stage. A first and second signal output of the oscillator stage each are fed back to a respective reset input by way of a switching stage determining the amplitude of an adjusting step of the press ram. One reset input is connected with a change-over stage which senses the bottom end position of the press ram with the first signal activating the motor in the sense of a "ram up" and the second signal output activating the motor in the sense of a "ram down".

By virtue of the last-mentioned features of the present invention, an additional advantage is obtained in that a cutting force indication is simultaneously obtained also with respect to an overload protection arrangement such as proposed in German Offenlegungsschrift No. 26 34 385.

The cutting force measuring sensor of the present invention may be constructed as a piezoelectric element. The oscillator stage may be constructed with two flip flops. Moreover, the reset inputs, connected to a switching correction stage, determine an initial state of the oscillator stage. The oscillator stage, in accordance with the present invention, may be constructed with two monostable multivibrators, i.e., so-called one-shot multivibrators.

In other than the generic type of high-speed cutting presses, the circuit arrangement of the present invention can also be applied to an adjustable press platen, adjustable top or bottom dies, a mounting plate designed to be height adjustable by, for example, wedge adjustment, as well as to adjusting systems engaging the frame or stand of the press. Of particular significance in this arrangement is a mounting plate for use in older type high-speed cutting presses which mounting plate could readily be supplied as an accessory.

Accordingly, it is an object of the present invention to provide a circuit arrangement for an adjusting drive of a press ram of a high-speed cutting press which avoids, by simple means, shortcomings and disadvantages encountered in the prior art.

Another object of the present invention resides in providing a circuit arrangement for an adjusting drive of a press ram of a high-speed cutting press which offers a high degree of operational safety.

A further object of the present invention resides in providing a circuit arrangement for an adjusting drive of a press ram of a high-speed cutting press which is simple in construction and easily adjustable.

Yet another object of the present invention resides in providing a circuit arrangement for an adjusting drive of a press ram of a high-speed cutting press which insures the maintenance of the penetration of the top die into the bottom die at a constant value.

A still further object of the present invention resides in providing a circuit arrangement for an adjusting drive for a press ram of a high-speed cutting press which functions reliably under all operating conditions.

Another object of the present invention resides in providing a circuit arrangement for an adjusting drive of a press ram of a high-speed cutting press which provides a simultaneous cutting force indication and an overload protection.

Figure 2:
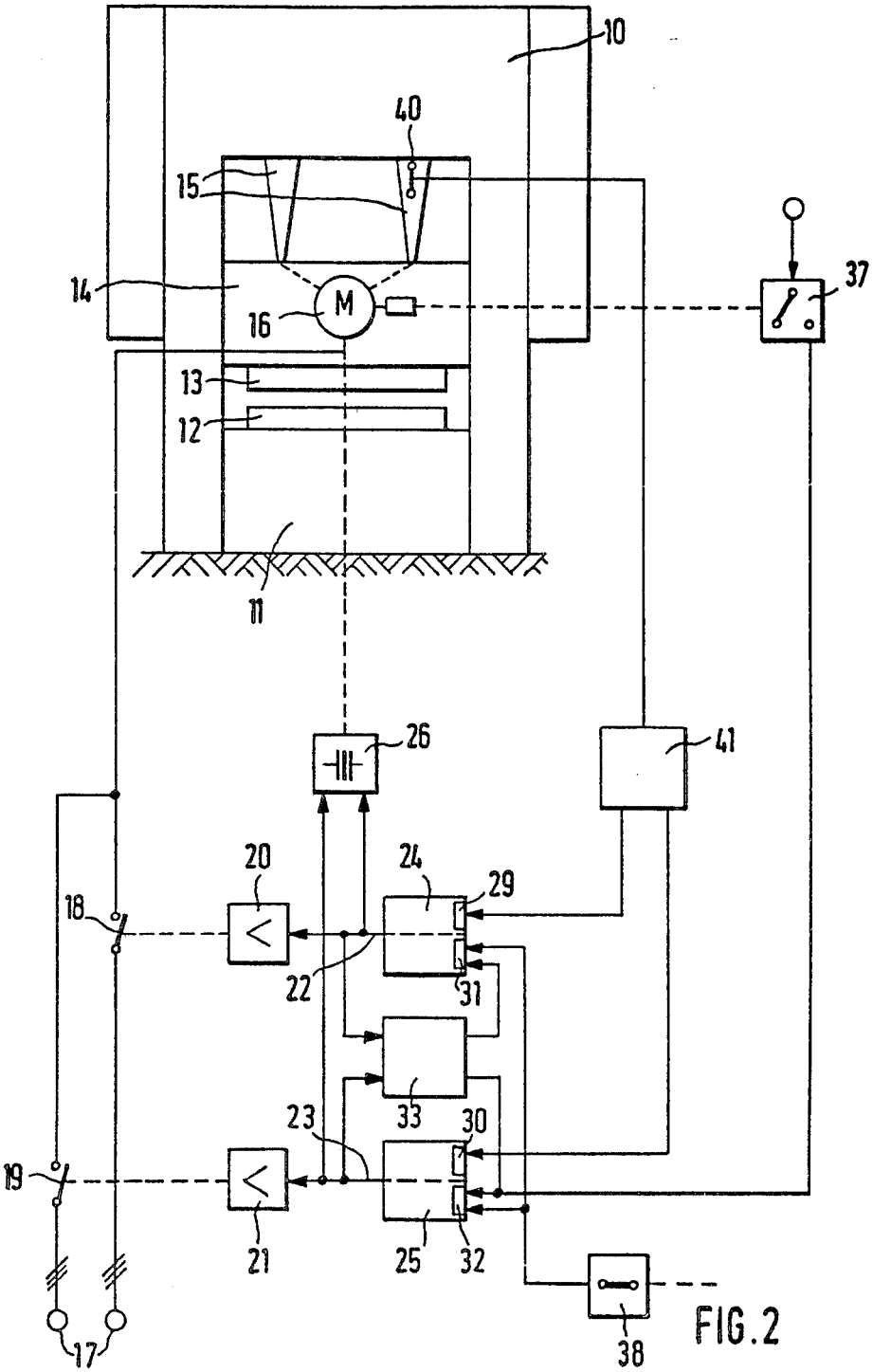

These and other objects, features, and advantages of the present invention will become more apparent from the following description when taken in connection with the accompanying drawings which show, for the purposes of illustration only, two embodiments in accordance with the present invention, and wherein:

FIG. 1 is a partially schematic view of a high-speed press provided with a circuit arrangement in accordance with the present invention utilizing limit switches; and FIG. 2 is a partially schematic view of a high-speed press provided with a circuit arrangement in accordance with a second embodiment of the present invention employing a cutting force measuring sensor.

Referring now to the drawings wherein like reference numerals are used throughout the various views to designate like parts and, more particularly, to FIG. 1. According to this figure, a high-speed cutting press 10 includes a press platen 11 having mounted thereon a bottom die 12 with an associated top die 13 being attached to a press ram operatively connected by an operating crank to an eccentric shaft (not shown) of a press drive system. The press ram 14 is connected, via a gear train, shown schematically at 43, having a high transmission ratio, to operating cranks 15 so that it can be adjusted with respect to the operating cranks. The gear train is driven by a motor 16 which is supplied with current from a three-phase network 17 in such a manner that the direction of rotation of the motor 16 can be selectively switched. For example, if the motor is required to be activated so as to raise the press ram 14, i.e., a "ram up" activation, a switch or circuit breaker 18 is actuated 1 and if the motor 16 is required to be activated so as to lower the press ram 14, i.e., a "ram down" activation, a switch or circuit breaker 19 is actuated.

The circuit breakers 18, 19 are actuated by amplifier stages 20, 21. The amplifier stage 20 is connected to a first signal output 22 The amplifier stage 21 is connected to a second signal output 23 of an oscillator stage which includes two flip flops 24, 25. A tensioning system 26, illustrated diagrammatically as a function block, is actuated by signal outputs 22, 23 of the flip flops 24, 25 by means of which the operating cranks 15 are tensioned with respect to the press ram 14 in their pivotal pressure points by, preferably, hydraulic means, after a completed adjustment or are released, that is, slackened off, at the beginning of an adjustment.

As shown in FIG. 1, the cutting press 10 includes a first bottom limit switch 27 and a second top limit switch 28 which are adjustably mounted and disposed in the path of action of the press ram 14. The signal output of the first limit switch 27 is connected to a first set input 29 of the oscillator stage, i.e., the flip flop 24, while the signal output of the second limit switch 28 is connected to a second set input 30 of the oscillator stage, i.e., the flip flop 25. The signal outputs 22, 23 of the flip flops 24, 25 are each fed to a reset input 31, 32 by way of a switching stage 33 which is constructed so as to determine the amplitude of an adjusting step. The switching stage 38 can be constructed as a timing element, a counting element, or an element providing an equivalent function for timing purposes.

A sensing switch 34 is disposed in series with the second top limit switch 28. The sensing switch 34 is actuated only during a predetermined short period of a stroke of the press ram 14. Preferably, a control drum 35 is provided for actuating the sensing switch 34. The control drum rotates in synchronism with the eccentric shaft and is present in every cutting press. Additionally, a normally closed contact switching element 36 is provided which picks up or senses an operating condition of the cutting press 10, i.e., a clutch in or clutch out condition.

A change-over stage 37 is disposed in series with the switching element 36 with the change-over stage 37 picking up or providing a signal of a bottom limit position of the press ram 14. The output of the change-over stage 37, which indicates the bottom limit position of the press ram 14, is connected to the reset input 32 of the oscillator stage flip flop 25. The other output of the change-over stage 37 is connected to the set input 30 of the oscillator stage flip flop 25. Both inputs 31, 32 of the flip flops 24, 25 are also connected to a switching correction stage 38 which insures that the flip flops 24, 25 assume a specified initial state at the start of operation of the press 10.

As shown in FIG. 2, in lieu of limit switches 27, 28, a cutting force measuring sensor 40 is attached to an operating crank 15. As can be appreciated, the cutting force measuring sensor 40 may also be optionally disposed at another suitable place of the cutting press 10. The cutting force measuring sensor 40 provides an output signal of an increase in the cutting force as well as a dropping or decrease in the cutting force. A signal output indicating an increase in the cutting force is connected to the set input 29 with the signal output indicating a decrease or dropping of the cutting force being connected to the set input 30 of the oscillator stage flip flops 24, 25. The switching stage 33 which determines the magnitude of an adjusting step is interposed between the flip flops 24, 25 as in FIG. 1 while the change-over stage 37 indicating the bottom limit position of the press ram is only fed to the reset input 32 of the oscillator stage flip flop 25. The switching correction stage 38, connected to the reset inputs 31, 32 of the oscillator stage flip flops 24, 25 insures that the flip flops 24, 25 will assume a specified initial state at the beginning of operation of the high-speed press 10. It is also possible in the circuit arrangement of the present invention to simplify the same by omitting the second limit switch 28 as well as the feedback of the flip flop 25 of the oscillator stage. Moreover, instead of motor 16, as can be appreciated, a different adjusting element such as, for example, a cylinder-piston unit actuated by a hydraulic pressure means can also be employed. Furthermore, the circuit arrangement of the present invention may also be readily applied to a hydraulically actuated high-speed press.

The circuit arrangement of FIG. 1 functions as follows:

On a starting up of the complete press system, the switching correction stage 38 is actuated which causes the reset inputs 31, 32 of the flip flops 24, 25 to be actuated, thereby setting the oscillator stage in its initial state. The cutting press 10 is started by engaging the clutch and releasing the brakes, thereby actuating or opening the switching element 36. The cutting press 10 is now run up to its high operating speed which, of necessity, produces an increase in depth to which the upper die 13 penetrates into the lower die 12. This increase in penetration of the dies causes the first bottom limit switch 27 to be contacted by the press ram 14 and the flip flop 24 is actuated by way of the first set input 29 so as to supply at its first signal output 22 an adjusting signal to the tensioning system 26 as well as a signal to the switching stage 33 and the amplifier 20. The adjusting signal to the tensioning system 26 is in the sense of a "release tensioning" signal. The supplying of the output signal by the set input 29 causes the switch or circuit breaker 18 to be closed and the motor 16 is then started so as to rotate in the "ram up" direction. The change-over stage 37 is actuated since the press ram 14 is leaving its bottom limit position.

After a predetermined period of time, determined by the switching stage 33, the reset input 31 of the flip flop 24 is actuated and the tensioning system 26 is then controlled in the sense of a "tension". At the same time, the switch or circuit breaker 18 is opened so that the motor 16 is stopped.

However, if the first bottom limit switch 27 is still contacted by the press ram 14 which is the normal case in the running up phase of the cutting press 10, the switching stage 33 will continue to be actuated until the limit switch 27 is no longer contacted by the press ram 14. During the running up phase, the switch or circuit breaker 18 remains closed and the tensioning system 26 remains actuated in the sense of a "release tension". If the cutting press 10 has reached its operating speed, a quasi-stable state is assumed in which the flip flops 24 and 25 of the oscillator stage assume their initial state. If the depth to which the upper die 13 penetrates into the lower die 12 is reduced, the second upper limit switch 28 is actuated for a short period of time when the press ram is at the dead center position which is determined by the sensor switch 34 controlled by the positioning of the control drum 35. The sensor switch 34 actuates the second set input of the flip flop 25. At the second signal output 23 of the flip flop 25, an adjusting signal is provided which, by way of the amplifier 21, closes the switch or circuit breaker 19 and also actuates the switching stage 33 as well as the tensioning system 26 so as to cause a "release tension" in the tensioning system 26. The motor 16, supplied by the three-phase network 17, is rotated in a ram-down direction, equivalent to the action described hereinabove, for as long as the second upper limit switch 28 is contacted by the press ram 14 within the period of time preset by the sensor switch 34. In the bottom limit position of the press ram 14, the change-over stage 37 is actuated as well as the reset input 32 and subsequently, the motor 16 is stopped in every case.

In the simplified embodiment described hereinabove, wherein the second upper limit switch 28 is omitted, the construction is based on the operating method which is customary in practice, that is, the cutting press 10 is run up from a starting speed but is stopped abruptly out of its operating speed by disengaging the clutch and the engaging brake. In such a construction, the circuit with the switching element 36 and the change-over stage 37 is adequate. The second input 30 of the flip flop 25 of the oscillator stage is kept actuated until the press ram 14 has reached its bottom limit position which stops the motor 16 in the manner described hereinabove.

The simplified embodiment may also be provided with an acceleration and retardation indicator 42 which is connected to the switching stage 36 in such a manner that output signals may be fed into the circuit arrangement only when the clutch of the high-speed press 10 is engaged. Any retardation of the cutting press 10 out of a high speed thus results in a signal at the set input 30 of the flip flop 25 of the oscillator stage. The motor 16 is maintained actuated in a ram-down direction of rotation until the indicator 42 returns to its drawn or rest position or the cutting press 10 is accelerated.

In the arrangement of FIG. 2, as noted above, instead of limit switches 27, 28, a cutting force measuring sensor 40, constructed preferably as a piezoelectric element, is arranged at the operating crank 15. The forces occurring at the operating crank 15 are sensed and fed to an evaluator 41 which, by means of a press related factor, actuates the set inputs 29, 30 of the flip flops 24, 25 of the oscillator stage with an increase in force corresponding to an increase in depth or with a decrease in force corresponding to a decrease in the depth to which the top die 13 penetrates into the bottom die 12. As to the remaining operations, the circuit arrangement according to FIG. 2 corresponds to that described hereinabove in connection with FIG. 1.

Instead of a piezoelectric element, another force measuring means could be provided which is constructed as, for example, a wire strain gauge. Moreover, if monostable multivibrators, so-called one-shot multivibrators, are used for the oscillator stage, the switching correction stage 38 may be omitted since the monostable multivibrators, by operation, flop back to a stable initial state after the operation has stopped.

While we have shown and described several embodiments in accordance with the present invention, it is understood that the same is not limited thereto, but is susceptible of numerous changes and modifications as known to one having ordinary skill in the art, and we therefore do not wish to be limited to the details shown and described herein, but intend to cover all such modifications as are encompassed by the scope of the appended claims.

We claim:

1. In a high-speed cutting press comprising a press ram, a platen, an upper die means attached to the press ram, a lower die means attached to the platen, the upper die means being adapted to penetrate into the lower die means during a cutting operation, and drive means for driving the press ram to adjust the position thereof, the improvement comprising a control arrangement for the adjusting drive of the press ram comprising means for actuating the drive means, switching means for controlling the connection between the drive means and the actuating means so that said drive means may be actuated in either a direction to raise the press ram or a direction to lower the press ram, and means for maintaining a depth of penetration of the upper die means into the lower die means at a constant value during operation of the high-speed cutting press in dependence upon an operating condition of the high-speed cutting press, the maintaining means includes a force measuring sensor means, a circuit means receiving signals from the force measuring sensor means for evaluating the received signals and providing an output signal upon the occurrence of a predetermined output signal from the force measuring sensor means, and oscillator means connected to said evaluator circuit means and the drive means for actuating the drive means in a direction so as to one of raise and lower the press ram in response to a predetermined force sensed by the force measuring sensor means.

2. The control arrangement according to claim 1, wherein means are operatively connected with said oscillator means for determining an amplitude of an adjusting step of the press ram, and means are operatively connected with the oscillator means and drive means for sensing a bottom dead center position of the press ram.

3. The control arrangement according to one of claims 1 or 2, wherein the oscillator means includes two monostable multi-vibrators.

4. The control arrangement according to claim 2, wherein the oscillator means includes a first and second set input, a first and second reset input, a first and second signal output, and the output signal from the evaluating circuit means is connected to the first and second set inputs, the first and second signal output are fed back to one reset input by way of the adjusting step amplitude determining means.

5. The control arrangement according to claim 4, wherein the force measuring sensor means is constructed as a piezoelectric element.

6. The control arrangement according to one of claims 4 or 5, wherein the oscillator means is constructed with two flip flops, and the reset inputs are connected to a switching correction means for determining an initial state of the oscillator means.

* * * * *